US010493313B2

(12) United States Patent
Jones et al.

(10) Patent No.: US 10,493,313 B2
(45) Date of Patent: Dec. 3, 2019

(54) MOBILE WEIGHT TRAINING SYSTEM

(71) Applicant: XMT SOLUTIONS LLC, Great Falls, VA (US)

(72) Inventors: Monte Jones, Paso Robles, CA (US); Michael Humenansky, Chicago, IL (US); Steve Mack, Cleveland, OH (US); Ross Rosenstein, Charlottesville, VA (US); Jeremy Levine, Briarcliff Manor, NY (US); Nathan David, Tarrytown, NY (US)

(73) Assignee: XMT Solutions LLC, Great Falls, VA (US)

( * ) Notice: Subject to any disclaimer, the term of this patent is extended or adjusted under 35 U.S.C. 154(b) by 167 days.

(21) Appl. No.: 15/572,421

(22) PCT Filed: May 5, 2016

(86) PCT No.: PCT/US2016/030962

§ 371 (c)(1),
(2) Date: Nov. 7, 2017

(87) PCT Pub. No.: WO2016/179380

PCT Pub. Date: Nov. 10, 2016

(65) Prior Publication Data

US 2018/0133538 A1 May 17, 2018

Related U.S. Application Data

(60) Provisional application No. 62/158,498, filed on May 7, 2015.

(51) Int. Cl.
*A63B 21/075* (2006.01)
*A63B 71/00* (2006.01)
(Continued)

(52) U.S. Cl.
CPC ..... *A63B 21/075* (2013.01); *A63B 21/0602* (2013.01); *A63B 21/0603* (2013.01);
(Continued)

(58) Field of Classification Search
CPC ..... A63B 21/075; A63B 21/0722; A63B 21/0724; A63B 21/0603; A63B 21/0602;
(Continued)

(56) References Cited

U.S. PATENT DOCUMENTS 113,966 A 4/1871 Ellis
1,536,048 A 5/1925 Alastalo
(Continued)

FOREIGN PATENT DOCUMENTS

EP 0308387 3/1989
GB 2479417 10/2011

OTHER PUBLICATIONS

International Search Report/Written Opinion, dated Sep. 16, 2016, issued by USRO Blaine R. Copenheaver, 11 pgs.
(Continued)

*Primary Examiner* — Garrett K Atkinson
(74) *Attorney, Agent, or Firm* — Fish & Richardson P.C.

(57) ABSTRACT

In one aspect, the invention features a barbell including a first end portion, a second end portion, and a middle portion, where the middle portion is couplable to the first end portion and the second end portion. The middle portion includes a male coupling extending from a first end of the middle portion, the male coupling providing a first coupling mechanism that engages with a corresponding female coupling of the first end portion, and a female coupling providing a second coupling mechanism that engages with a corresponding male coupling of the second end portion.

20 Claims, 10 Drawing Sheets

(51) Int. Cl.
*A63B 21/06* (2006.01)
*A63B 21/072* (2006.01)
*A63B 71/06* (2006.01)

(52) U.S. Cl.
CPC ..... *A63B 21/0722* (2015.10); *A63B 21/0724* (2013.01); *A63B 71/0036* (2013.01); *A63B 21/0728* (2013.01); *A63B 71/0622* (2013.01); *A63B 2071/065* (2013.01); *A63B 2071/0658* (2013.01); *A63B 2071/0694* (2013.01); *A63B 2209/10* (2013.01); *A63B 2220/52* (2013.01); *A63B 2220/56* (2013.01)

(58) Field of Classification Search
CPC ..... A63B 71/0036; A63B 2220/56; A63B 2220/52; A63B 2209/10; A63B 2071/0694; A63B 2071/0658; A63B 2071/065; A63B 21/0728; A63B 71/0622; A63B 2220/51; A63B 2210/50; A63B 2071/0683
See application file for complete search history.

(56) References Cited

U.S. PATENT DOCUMENTS 3,185,476 A 5/1965 Fechner
3,610,617 A * 10/1971 Hepburn ..... A63B 21/015 482/116
3,781,007 A * 12/1973 Baker ..... A63B 21/0602 482/108
4,029,312 A 6/1977 Wright
4,743,016 A 5/1988 Van Derworp
5,300,001 A * 4/1994 Sealy ..... A63B 21/0602 128/DIG. 15
5,868,652 A * 2/1999 Spletzer ..... A63B 21/0605 2/22
5,997,442 A 12/1999 Cordes
6,099,441 A * 8/2000 Bonnet ..... A63B 21/072 482/106
6,123,651 A * 9/2000 Ellenburg ..... A63B 71/0036 482/104
7,585,262 B1 9/2009 Vayntraub
7,828,703 B1 * 11/2010 Boesch ..... A63B 21/0602 482/112
7,922,633 B2 * 4/2011 Januszek ..... A63B 21/0728 482/107
8,047,974 B1 * 11/2011 Kanelos ..... A63B 21/0724 482/106
8,343,019 B2 * 1/2013 Friend ..... A63B 21/0603 482/105
2003/0130070 A1 * 7/2003 Nolan ..... A63B 21/0605 473/437
2005/0244795 A1 11/2005 Long
2009/0318273 A1 12/2009 Fenelon
2014/0018214 A1 1/2014 Jordan
2015/0202486 A1 * 7/2015 Childs ..... A63B 21/075 482/106
2015/0367163 A1 * 12/2015 Moran ..... A63B 21/075 482/108
2016/0059064 A1 * 3/2016 Smith ..... A63B 21/0728 482/5
2016/0263420 A1 * 9/2016 DuMee ..... A63B 21/0552
2018/0236298 A1 * 8/2018 Donnelly ..... A63B 21/0726

OTHER PUBLICATIONS

EP Extended European Search Report in European Application No. 16790078.6, dated May 7, 2019, 13 pages.
EP Supplementary Partial European Search Report in European Application No. 16790078.6, dated Jan. 23, 2019, 12 pages.
International Preliminary Examination Report for Application No. PCT/US2016/030962, dated Nov. 16, 2017, 8 pgs.

* cited by examiner

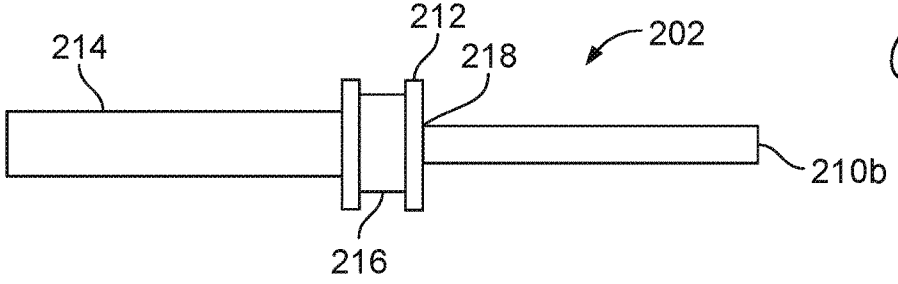
FIG. 3A
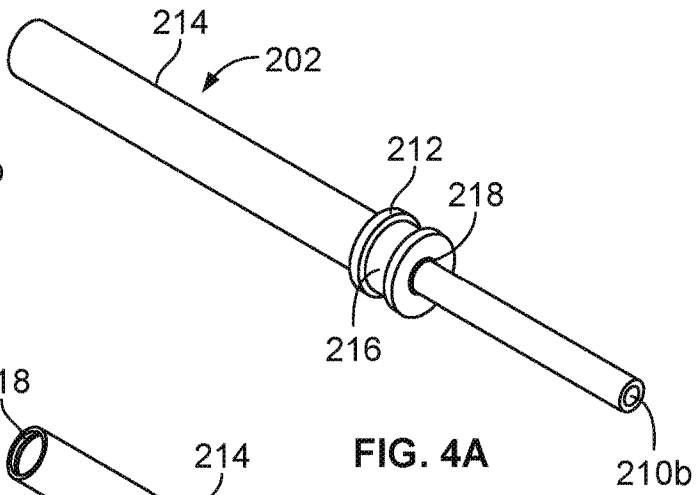
FIG. 4A
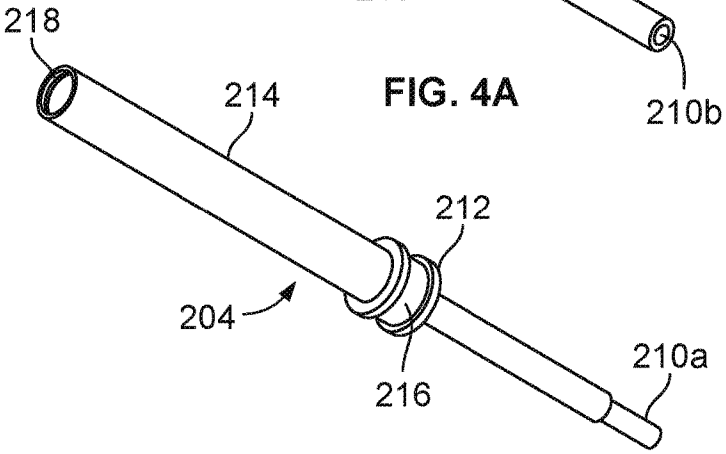
FIG. 4B
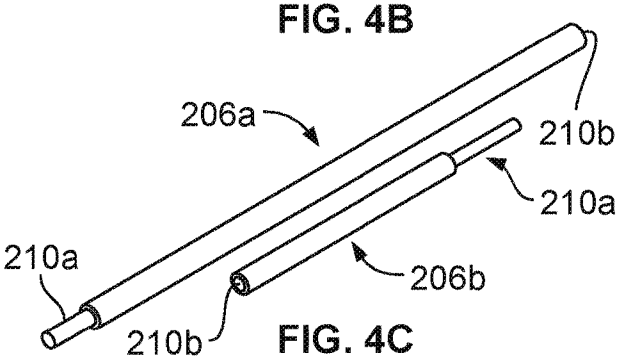
FIG. 4C
FIG. 3B
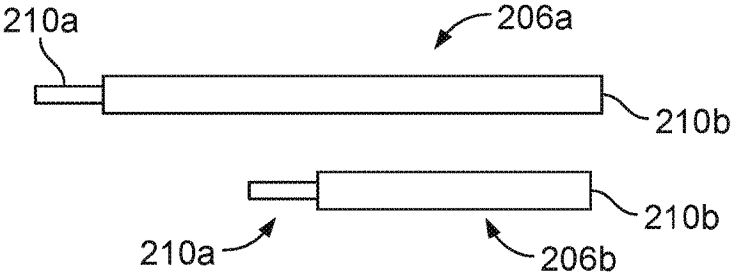
FIG. 3C

MOBILE WEIGHT TRAINING SYSTEM

CROSS-REFERENCE TO RELATED APPLICATION(S)

This application is a U.S. National Phase Application under 35 U.S.C. § 371 and claims the benefit of priority to International Application Serial No. PCT/US2016/030962, filed May 5, 2016, which claims priority to U.S. Provisional Application Ser. No. 62/158,498, filed May 7, 2015, the contents of which are hereby incorporated by reference.

BACKGROUND

Individuals involved in certain professions such as, for example, the military, law enforcement, and extreme sports, may travel to locations where traditional weight training equipment is unavailable. Yet, these professions demand that their members maintain peak fitness. Moreover, traditional weight systems are heavy and unwieldy, hence limiting the type of workout equipment or amount of weights that can be transported to such locations.

SUMMARY

This specification relates to a mobile weight training system. More specifically, a mobile weight training system can include a mobile barbell, several weight holders, and a system of filler bags. The filler bags can be filled with various readily available materials (e.g., sand, dirt, water, gravel, etc.) and inserted into the weight holders to create weights for use with the barbell. The system of filler bags can include several filler bags of different sizes, each size designed to hold an approximate weight of a material. For example, such a mobile weight training system can include enough weight holders and filler bags to produce 270 pounds of weight when filled, but with a travel weight (e.g., weight of the system with empty filler bags) not much greater that the weight of the barbell alone. Consequently, the weight training system may be adaptable to a user's needs while minimizing the storage weight and size of the system.

A first general aspect of the subject matter described in this specification can be embodied in a barbell including a first end portion, a second end portion, and a middle portion, where the middle portion is couplable to the first end portion and the second end portion. The middle portion includes a male coupling extending from a first end of the middle portion, the male coupling providing a first coupling mechanism that engages with a corresponding female coupling of the first end portion, and a female coupling providing a second coupling mechanism that engages with a corresponding male coupling of the second end portion.

This and other implementations can each optionally include one or more of the following features. The first and second coupling mechanisms can be threading. The threading can extend from the first end of the middle portion along only a portion of a length of the male coupling. The threading can extend from an end of the second end portion along only a portion of a length of the corresponding male coupling. The first and second coupling mechanisms can include plunger buttons and corresponding holes. The first and second coupling mechanisms can include pins. The first and second coupling mechanisms can include locking sleeves. The female coupling of the first end portion and the male coupling of the second end portion can be corresponding couplings so as to couple the first end portion with the second end portion without the middle portion.

The first end portion can be configured to hold a weight at an end of the first end portion opposite the female coupling on the first end portion, and the second end portion can be configured to hold a weight at an end of the second end portion opposite the male coupling on the second end portion. The barbell can include a first cylindrical collar coaxially attached to the first end portion, the first collar having a channel formed around an outer circumference of the collar, and a second a second cylindrical collar coaxially attached to the second end portion, the second collar having a channel formed around an outer circumference of the collar.

A weight sensing device can be mounted on one of the first end portion or the second end portion. The weight sensing device can be a mechanical scale. The weight sensing device can be integrated into a collar attached to the first end portion or the second end portion. The weight sensing device can be a pressure sensor communicatively coupled to an electronic display.

A second general aspect, combinable with the first general aspect, can be embodied in an exercise weight including a flexible weight holder having a plurality of sealable chambers, the chambers arranged along a length of the weight holder and oriented transverse to the length of the weight holder, and each chamber having a closure device for securing one or more weights within each chamber. One or more straps attached to a first end of the weight holder, the first end being transverse to the length of the weight holder. And, one or more strap fastening devices attached at a second end of the weight holder, the second end being transverse to the length of the weight holder, where the weight holder is rolled into a cylinder shape when each of the straps are fastened to corresponding ones of the strap fastening devices.

This and other implementations can each optionally include one or more of the following features. The strap fastening devices can be hook and loop fasteners, where the straps include one of the hooks or the loops of the hook and loop fasteners and the other of the hooks of the loops of the hook and loop fasteners are attached to a surface of the weight holder at the second end.

The strap fastening devices can include one of double D-rings, buckles, clips, or snaps. At least one handle can be attached to a surface of the weight holder. The weight holder, when rolled into the cylinder shape, can define an passage running transverse to the length of the weight holder, such that the weight holder can be wrapped around an end of a barbell.

A third general aspect, combinable with any of the previous aspects, can be embodied in a weight training system including a barbell and two or more exercise weights. The barbell including a first end portion, a second end portion, and a middle portion couplable to the first end portion and the second end portion. The middle portion having a male coupling extending from a first end of the middle portion, the male coupling providing a first coupling mechanism that engages with a corresponding female coupling of the first end portion, and a female coupling providing a second coupling mechanism that engages with a corresponding male coupling of the second end portion. Each of the two or more exercise weights including a flexible weight holder having a plurality of chambers, the chambers arranged along a length of the weight holder and oriented transverse to the length of the weight holder, and each chamber having a closure device for securing one or more weights within each chamber, one or more straps attached to a first end of the weight holder, the first end being transverse to the length of the weight holder, and one or more strap fastening devices attached at a second end of the weight holder, the second end being transverse to the length of the weight holder, wherein the weight holder is rolled into a cylinder shape when each of the straps are fastened to corresponding ones of the strap fastening devices.

This and other implementations can each optionally include one or more of the following features. A plurality of filler bags, each filler bag being sized to accommodate an amount of a material that approximates a weight of each filler bag, and each filler bag fitting within the chambers of the weight holders. The material can be one of water, sand, dirt, or gravel.

A fourth general aspect, combinable with any of the previous aspects, can be embodied in a method of assembling a weight training system including the steps of assembling a barbell by: coupling a male coupling of a first end portion to a female coupling of a middle portion, and coupling a male coupling of the middle portion to a female coupling of a second end portion. Assembling a first weight for the barbell by: adding a material to a filler bag and sealing the filler bag, inserting the filler bag in a chamber of a first weight holder, and sealing the chamber of the weight holder. And, attaching the first weight to the barbell by wrapping the first weight holder around the first end portion or the second end portion, and securing straps on the first weight holder to corresponding strap fasteners on the first weight holder.

This and other implementations can each optionally include one or more of the following features. Assembling a second weight for the barbell by: adding a material to a second filler bag and sealing the second filler bag, inserting the second filler bag in a chamber of a second weight holder, and sealing the chamber of the second weight holder. Attaching the second weight to the barbell by placing a handle of a second weight holder into a channel of a collar on the first end portion or the second end portion of the barbell. Attaching the second weight to the barbell by wrapping the second weight holder around the first weight, and securing straps on the second weight holder to corresponding strap fasteners on the second weight holder.

Particular implementations of the subject matter described in this specification can be implemented so as to realize one or more of the following advantages. Implementations may provide a compact and light-weight weight training system. Implementations may be adaptable to different training styles. Further, implementations may permit use with both conventional plate weights and non-conventional weights with a barbell.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

FIGS. 3A-3C depict detail views of parts of the example mobile barbell in accordance with implementations of the present disclosure.

FIGS. 4A-4C depict perspective views of the parts of the example mobile barbell in accordance with implementations of the present disclosure.

Like reference numbers and designations in the various drawings indicate like elements.

DETAILED DESCRIPTION

Figure 1:
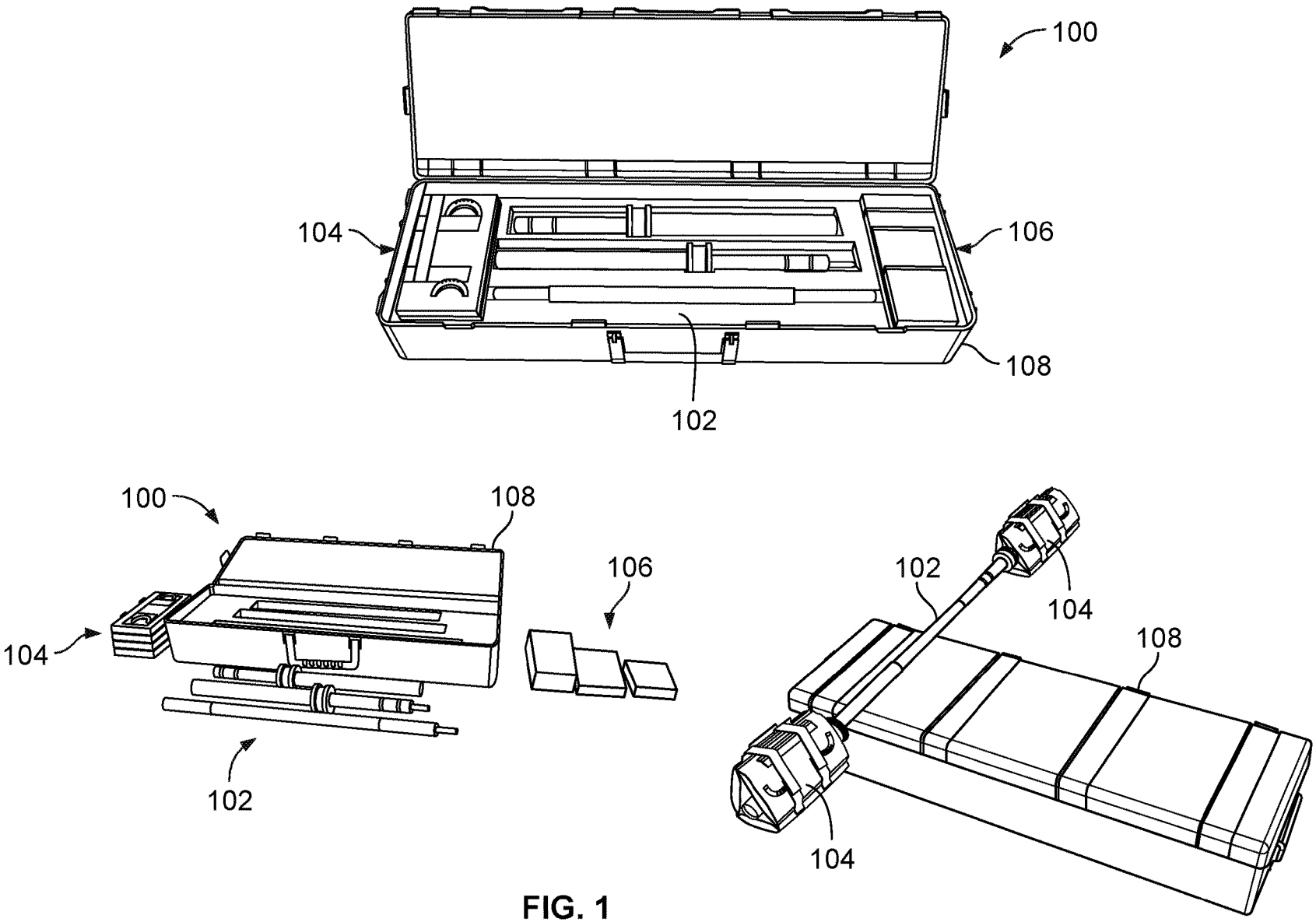
FIG. 1 depicts an example mobile weight training system in accordance with implementations of the present disclosure.

FIG. 1 depicts an example mobile weight training system 100 in accordance with implementations of the present disclosure. The system 100 includes a collapsible barbell 102, a set of weight holders 104, a system of filler bags 106, and a case 108 that can double as a weight-bench. The filler bags 106 can be filled with various readily available materials such as, but not limited to, sand, dirt, water, or gravel, and attached to the weight holders 104 to create weights for use with the barbell. The weight holders 104 can be attached to the barbell 102 by wrapping the weight holders 104 around the ends of the barbell 102 or, in some examples, by hanging the weight holders 104 from the barbell using a handle on the weight holder 104 (e.g., as shown in FIGS. 2D and 9C).

The system of filler bags 106 can include several filler bags 106 of different sizes, each size designed to hold an approximate weight of material (e.g., 5, 10, and 15 pounds). For example, such a mobile weight training system 100 can include enough weight holders 104 and filler bags 106 to produce 270 pounds of weight when filled (e.g., 6 weight holders, 12-15 lb bags, 6-10 lb bags, and 6-5 lb bags), but with a travel weight (e.g., weight of the system with empty filler bags) not much greater that the weight of the barbell 102 alone.

Figure 2A:
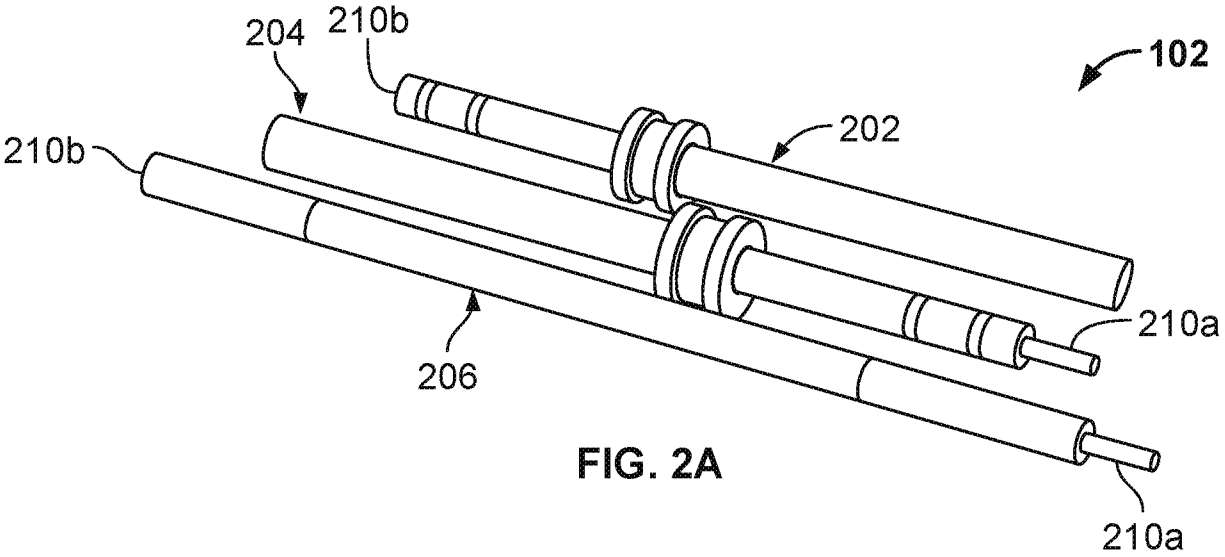
FIGS. 2A-2D depict various views of an example mobile barbell in accordance with implementations of the present disclosure.
Figure 2B:
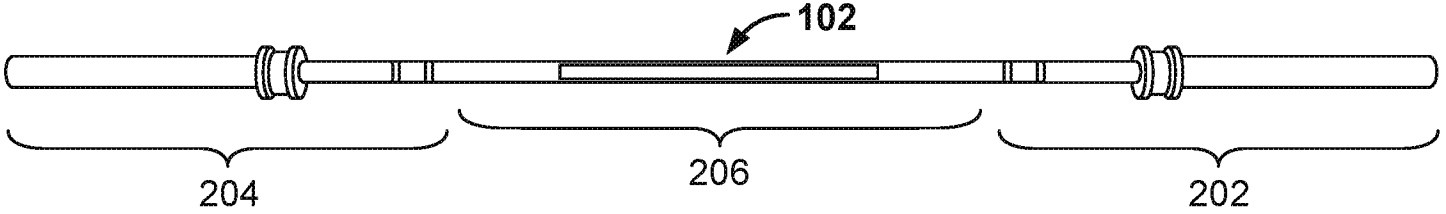
Figure 2C:
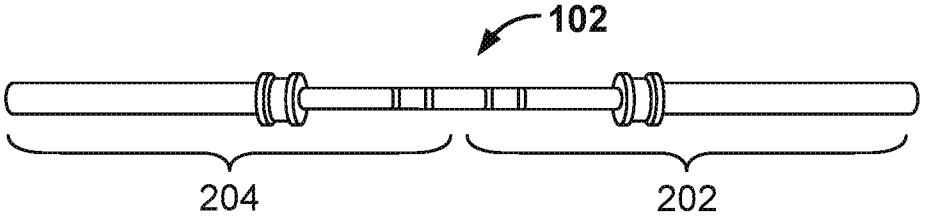
Figure 2D:
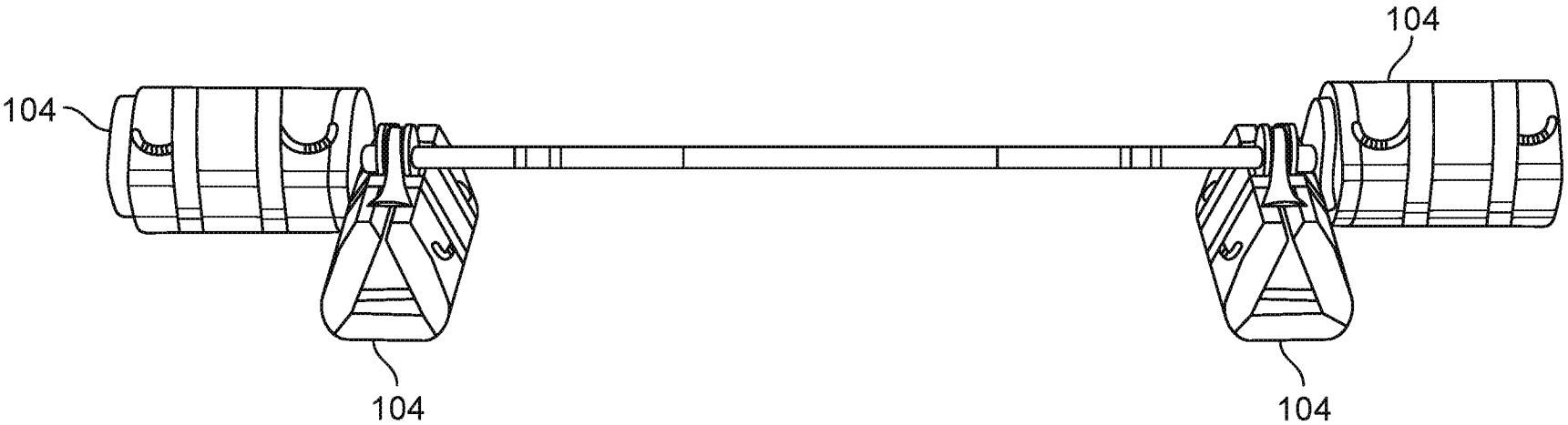

FIGS. 2A-2D depict various views of an example mobile barbell 102 in accordance with implementations of the present disclosure. FIGS. 2A-2C show various configurations of the barbell 102, and FIG. 2D shows the barbell 102 with weight holders 104 attached. Referring first to FIGS. 2A-2C, the barbell 102 can be broken down into three separate parts (202, 204, 206) for storage and travel. The parts include two end portions (female end portion 202 and male end portion 204) and a middle portion 206. Each end portion 202, 204 has either a male coupling 210*a* (male end portion 204) or a female coupling 210*b* (female end portion 202). The middle section 206 has a male coupling 210*a* at one end and a female coupling 210*b* the opposite end. The couplings 210*a*, 210*b* secure the end portions 202, 204 of the barbell to the middle portion 206. Specifically, to assemble the barbell 102, the male coupling 210*a* on the male end portion 204 fastens to the female coupling 210*b* of the middle portion 206, and the female coupling 210*b* of female end portion 202 fastens to the male coupling 210*a* of the middle portion 206. As described in more detail below in reference to FIGS. 5, 6A, and 6B, the couplings 210*a*, 210*b* can include any of several different coupling mechanisms (e.g., threading, pins, or plunger buttons) to fasten the parts of the barbell 102 together.

FIGS. 3A-3C and 4A-4C depict detail and perspective views, respectively, of each of the parts (portions 202, 204, 206) of the barbell 102. FIGS. 3A and 4A show detail and perspective views of the female end portion 202. The female end portion 202 includes a collar 212 and a hollow cylindrical sleeve 214 attached coaxially to the female end portion 202. Either the collar 212, the sleeve 214, or both can be attached to the female end portion 202 such that they are free to rotate around the female end portion 202. For example, the collar 212 and sleeve 214 can be mounted on bearings (e.g., brass bushings) placed between the female end portion 202, and the collar and sleeve 214. In some examples, the collar 212 and the sleeve 214 can form a single assembly, for example, by affixing the collar 212 to the sleeve (e.g., by welding or press fitting the two together). In some implementations, the sleeve 214 and collar 212 can be formed in one piece. For example, the sleeve 214 and collar 212 be machined from one piece of material.

In some examples, a seal 218 (e.g., a gasket or V-seal) can be placed between the female end portion 202 and the collar 212, and/or between the female end portion 202 and the sleeve 214 to prevent debris from fouling the bearings and impeding the rotation of the collar 212 and/or the sleeve 214. In some examples, the V-seal is mounted axially on the bar, with a lip in contact with the bushing inside the collar/sleeve assembly to prevent debris from fouling the bushing from the interior side of the collar/sleeve assembly.

FIGS. 3B and 4B show detail and perspective views of the male end portion 204. The male end portion 204 includes a collar 212 and a hollow cylindrical sleeve 214 attached coaxially to the male end portion 204. Either the collar 212, the sleeve 214, or both can be attached to the male end portion 204 such that they are free to rotate around the female end portion 204. For example, the collar 212 and sleeve 214 can be mounted on bearings placed between male end portion 204, and the collar and sleeve 214. As noted above, in some examples, the collar 212 and the sleeve 214 can form a single assembly, for example, by affixing the collar 212 to the sleeve (e.g., by welding or press fitting the two together). In some implementations, the sleeve 214 and collar 212 can be formed in one piece. For example, the sleeve 214 and collar 212 be machined from one piece of material.

In some examples, a seal 218 (e.g., a gasket or v-seal) can be placed between the male end portion 204 and the collar 212, and/or between male end portion 204 and the sleeve 214 to prevent debris from fouling the bearings and impeding the rotation of the collar 212 and/or the sleeve 214. In some examples, the V-seal is mounted axially on the bar, with a lip in contact with the bushing inside the collar/sleeve assembly to prevent debris from fouling the bushing from the interior side of the collar/sleeve assembly.

As shown in FIG. 2D, the weight holders 104 are attached to the sleeves 214 of the barbell 102. Further, the sleeves 214 can have a diameter similar to industry standard Olympic barbell sleeves of, for example, 1 and 31/32 inches, such that the barbell 102 can be used with standard weights in addition to the weight holders 104. In addition to serving as a stopper for weights placed on the sleeves 214, the collars 212 can serve as a hanger for additional weight holders 104 (e.g., as shown in FIG. 2D). For example, referring again to FIGS. 3A-3B and 4A-4B, the collar 212 has a channel 216 formed in the outer surface and running along the circumference of the collar 212. The channel 216 can be sized to cradle a handle on the weight holders 104, thereby preventing a weight holder 104 hung from the barbell 102 from sliding during lifts.

In some implementations, as shown in FIG. 2B, the barbell 102, when fully assembled, has standard Olympic dimensions, for example, 2.2 m (7.2 ft) long and weighing 20 kg (44 lb), however, implementations may vary in weight and length, for example, to suit differing training routines. In some implementations, the barbell 102 can be slightly longer than an Olympic barbell, for example, to accommodate the longer weight holders 104 the sleeves 214 can be extended an appropriate distance, as compared to a standard Olympic barbell. In addition, the two end portions 202, 204 can be fastened together without the middle portion 206 by, for example, coupling the respective male 210*a* and female 210*b* couplings of the male 204 and female 202 end portions together to form a shorter barbell 102, for example, a curl bar (as shown in FIG. 2C).

Although a barbell 102 made up of three separate portions (202, 204, 206) is shown, in some examples, the barbell 102 can be made of more than three portions to, for example, make the barbell 102 even more compact for travel and storage. For example, as shown in FIGS. 3C and 4C, which show detail and perspective views of example middle portions, the middle portion 206 can be formed from two separate middle portions 206*a*, 206*b*. Each middle portion 206*a*, 206*b* has both male 210*a* and female 210*b* couplings. Further, the middle portions 206*a*, 206*b* can be of different lengths, for example, to permit more adaptability in barbell sizes. In some implementations, the middle portions 206*a*, 206*b* can be sized such that a woman's Olympic bar (e.g., 2.01 m (6.6 ft) long and weighing 15 kg (33 lb)) can formed using only one of the middle portions, and a men's Olympic bar can be formed using both of the middle portions.

Figure 5:
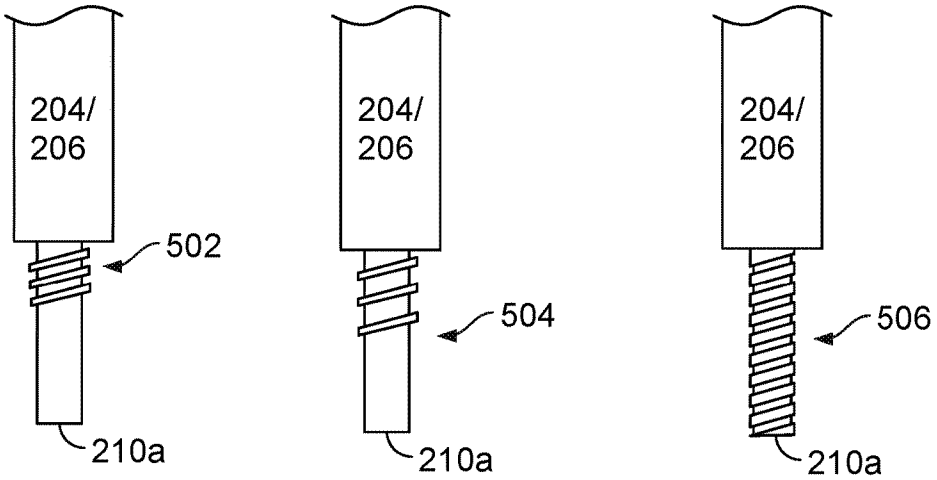
FIG. 5 depicts example threading configurations for coupling parts of a mobile barbell in accordance with implementations of the present disclosure.

FIG. 5 depicts example threading configurations that can be used as coupling mechanisms for the male 210*a* and female 210*b* couplings. Threading configurations 502 and 504 show threads extending from an end of a barbell portion (e.g., portion 204, 206) along only a portion the male coupling 210*a*. Further, threading configuration 502 shows a finer thread pitch than that of threading configuration 504. Also, threading configurations 502 and 504 represent undercut threading configurations (e.g., a configuration in which the shank of the male coupling has a diameter equal to the pitch diameter of the threads). Although not shown, threading configurations 502 and 504 can be modified, in some examples, such that the threaded portion of the male coupling 210*a* is at the distal end (e.g., the end away from the barbell portion 204, 206). In other words, the unthreaded portion of the male coupling 210*a* is proximate to the barbell portion 204, 206 and the threaded portion of the male coupling 210*a* is at the distal end of the male portion 210*a*.

Threading configuration 506 shows an example threading configuration in which the threads extend along the entire length of the male coupling 210*a*. Further, threading configuration 506 represents a full-bodied threading configuration (e.g., a configuration in which the shank of the male coupling has a diameter equal to the major diameter of the threads). Although not shown, the female couplings 210*b* are tapped with corresponding thread grooves.

Figure 6A:
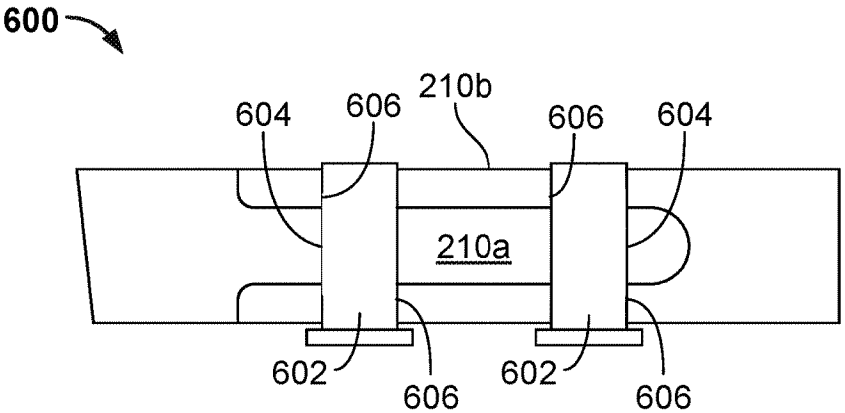
FIGS. 6A and 6B depict example coupling mechanism for coupling parts of a mobile barbell in accordance with implementations of the present disclosure.
Figure 6B:
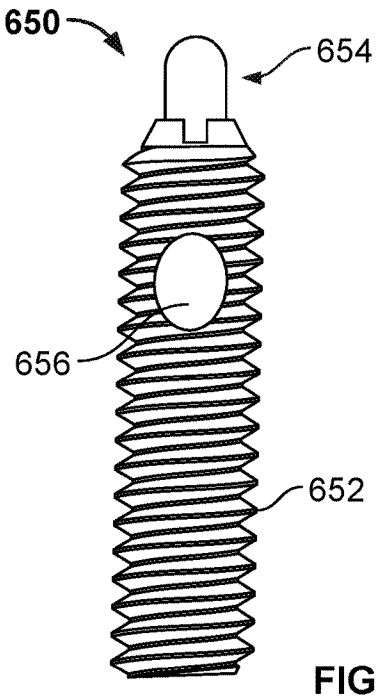

FIGS. 6A and 6B depict another example coupling mechanism for the male 210*a* and female 210*b* couplings. Referring first to FIG. 6A, FIG. 6A shows a cross-sectional view of a pin and hole type of coupling mechanism 600. The male 210*a* and female coupling 210*b* each have corresponding holes 604 and 606, respectively, which can be aligned when the male coupling 210*a* is inserted into the female coupling 210*b*. The two couplings 210*a*, 210*b* are secured together by pins 602 inserted through the aligned holes 604, 606.

In some implementations, the holes 604 in the male coupling 210*a* can be tapped to accept a spring and plunger assembly 650. The assembly 650 includes a threaded body 652 and a movable plunger 654 held under spring pressure by a spring (not shown) within the body 652. The plunger 654 can be moved into the body 652 against the spring pressure. When the assembly 650 is installed in the male coupling 210*a*, the plunger extends past the outer circumference of the male coupling 210*a* and can lock into a corresponding hole 606 in the female coupling 210*b*. In some examples, the assembly 650 can include a thread locking element 656 (e.g., nylon, thread locking tape, or thread locking liquid).

Figure 7:
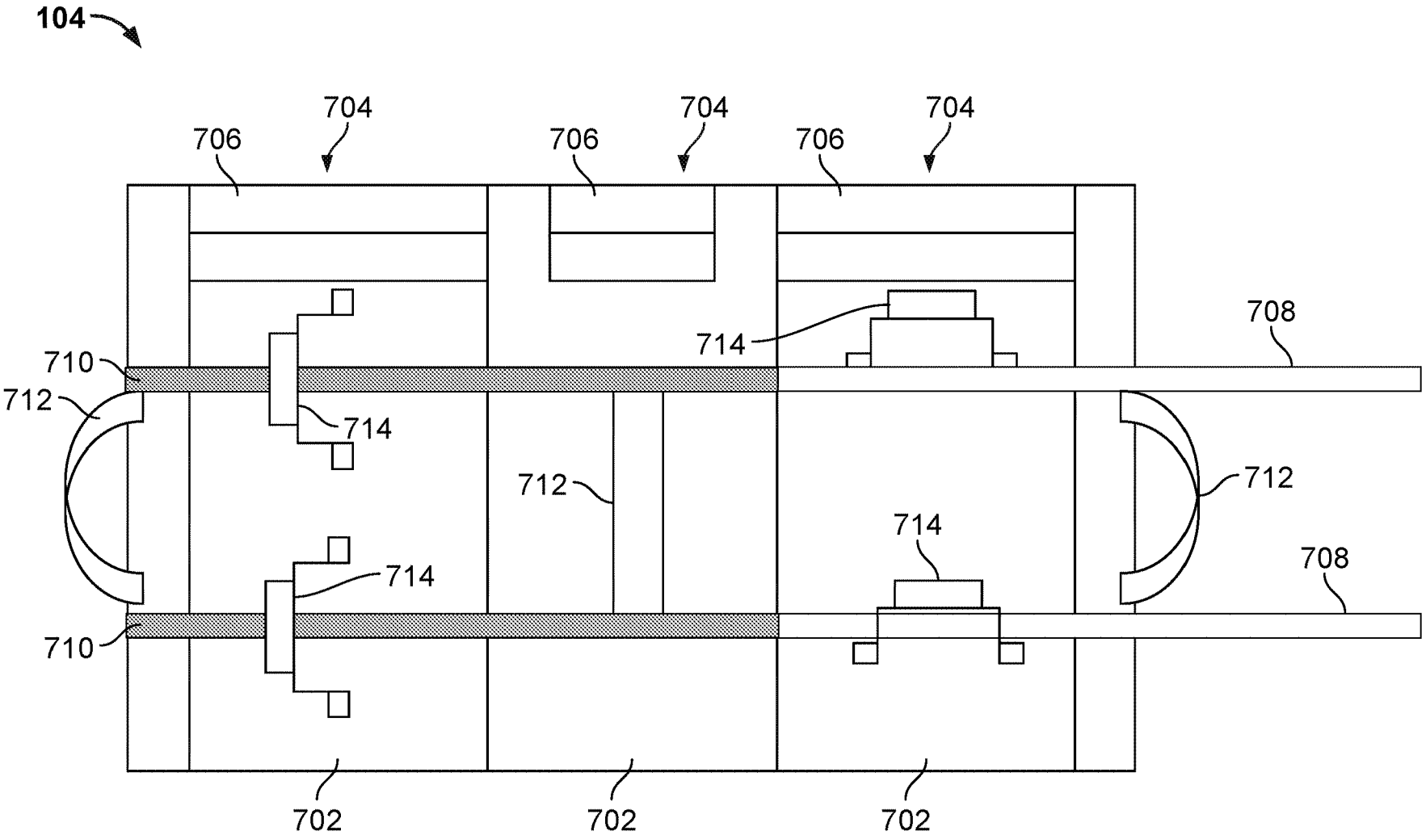
FIG. 7 depicts an example weight holder in accordance with implementations of the present disclosure.

FIG. 7 depicts an example weight holder 104 in accordance with implementations of the present disclosure. A front side of the weight holder 104 is shown in FIG. 7. The weight holder 104 is made of a strong but flexible material, for example, a fabric such as 1000 Denier Mil-Spec Cordura Nylon or other appropriate high strength fabric. The weight holder 104 has several sealable chambers 702 in which weights (e.g., filler bags 106) can be inserted. The chambers 702 have an opening 704 at one end, and a closure mechanism 706. The closure mechanism 706 can be, for example, a zipper or a flap with a fastening device such as, but not limited to, hook and loop fasteners, snaps, metal or plastic clips. In some examples, each chamber 702 has a separate closure mechanism (e.g., a separate flap). In some examples, the weight holder 104 has a single closure mechanism 706 (e.g., a single flap) that encloses all of the chambers 702.

The weight holder 104 has one or more straps 708 and corresponding strap fastening devices 710. The straps 708 are attached to an end of the weight holder 104 that is transverse to the orientation of the chambers 702, and the strap fastening devices 710 are attached at an opposite end of the weight holder 104, also transverse to the orientation of the chambers 702. The straps 708 and strap fastening devices 710 are positioned on the weight holder 104 such that, when the straps 708 are secured to corresponding strap fastening devices 710, the weight holder is wrapped into a hollow cylindrical shape (e.g., see FIGS. 8B and 9C), thereby allowing weight holders 104 to be wrapped around the sleeve 214 of a barbell 102. In some examples, the weight holder is made to lie flat when not wrapped into the cylinder shape, for example, making the weight holder more space-efficient during storage. In some examples, the strap fastening devices 710 can be hook or loop fasteners corresponding to respective loop or hook fasteners on the straps 708. In some examples, the strap fastening devices 710 can be fastening devices such as, but not limited to, double D-ring loops, buckles, S-hook straps, ladder lock buckles, metal or plastic clips (e.g., corresponding clips on the straps 708), or snaps.

Figure 8A:
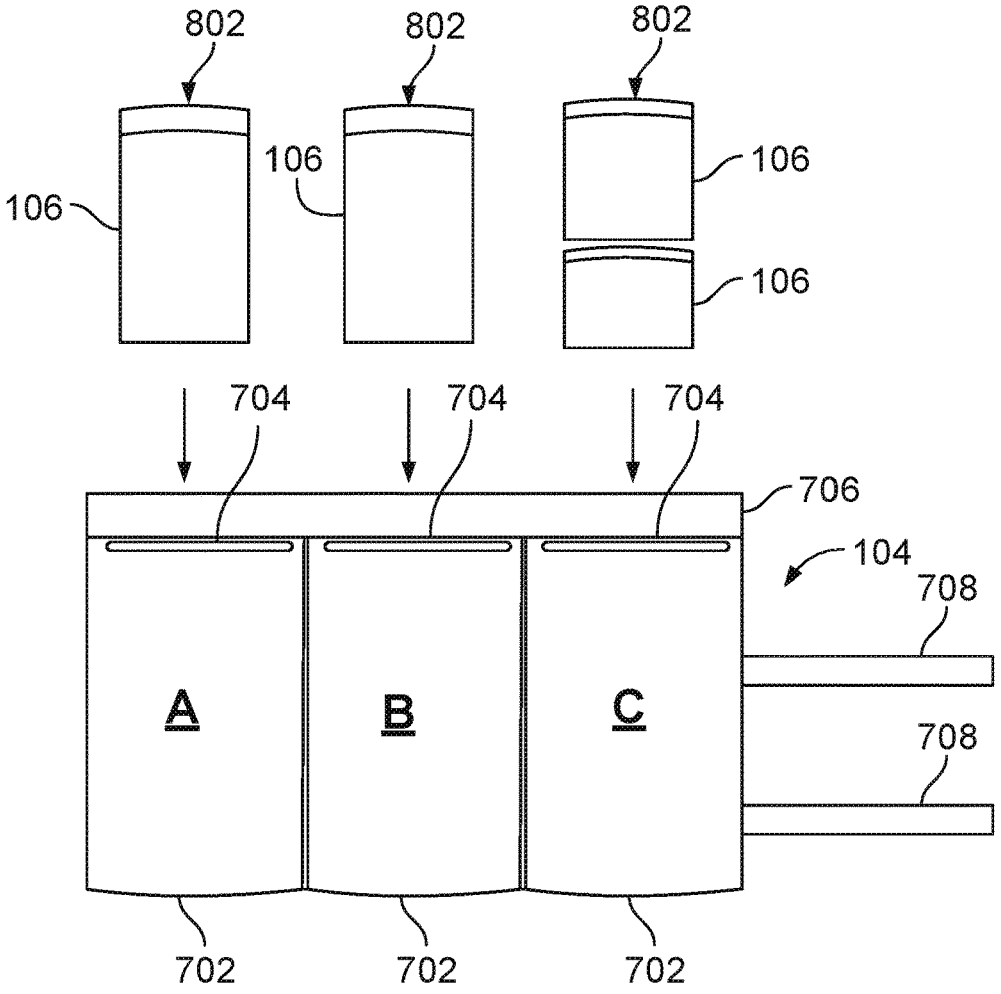
FIGS. 8A and 8B depict example filler bags and an example weight holder in accordance with implementations of the present disclosure.
Figure 8B:
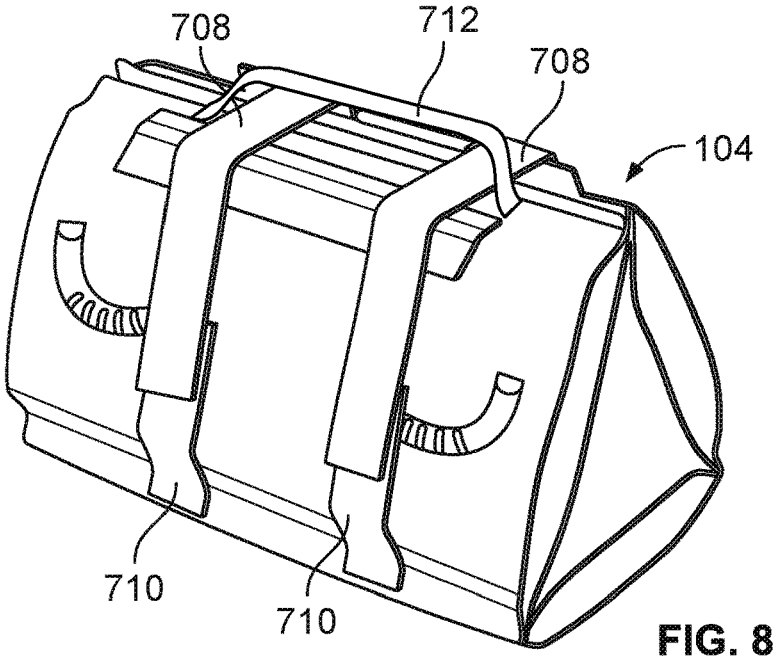

In some implementations, the weight holder 104 has three chambers 702, and the chambers are oriented on the weight holder such that, when the weight holder 104 is rolled up and the straps 708 secured, the weight holder 104 has a triangular cross-section (e.g., as shown in FIGS. 8B and 9C). In some examples, design (e.g., the cross section) of the weight holder 104 (when wrapped) makes the weight holder self-tightening around the barbell sleeves 214. In some implementations, each chamber 702 of the weight holder 104 is sized to hold fifteen pounds of filler bags 106 (e.g., 1-15 lb filler bag; 1-10 lb and 1-5 lb filler bag; or 3-5 lb filler bags), with a total fillable weight of 45 lbs.

In some examples, the weight holder 104 includes one or more handles 712, 714. The handles can be, for example, fabric handles 712 (e.g., nylon webbing) or molded plastic handles 714.

FIGS. 8A and 8B depict example filler bags 106 and an example weight holder 104 in accordance with implementations of the present disclosure. FIG. 8A shows a back side of the weight holder 104 and filler bags 106 being inserted into the weight holder 104. FIG. 8B shows an example weight holder 104 loaded with filler bags 106 and rolled up to be placed on an end of a barbell 102. For example, in order to attach the straps 708 to the strap fastening devices 710, the weight holder 104 is rolled into a cylindrical shape. More specifically, FIG. 8A shows filler bags 106 being inserted into the chambers 702 of a weight holder 104. For example, 15 lb filler bags are shown as being inserted into chambers A and B, and a 10 lb and a 5 lb filler bag are shown as being inserted into chamber C, for a total weight of 45 lbs. When a weight holder 104 is filled with a desired weight of filler bags 106, the weight holder 104 can be rolled into the configuration shown in FIG. 8B by attaching the straps 708 to corresponding strap fastening devices 710.

The filler bags 106 are made of a high strength flexible material such as, for example, 1000 Denier Mil-Spec Cordura Nylon. The filler bags 106 also have a closure mechanism 802, for example, similar to the closure mechanism 706 of the weight holder 104. The closure mechanism 802 can be, for example, a zipper or a flap with a fastening device such as, but not limited to, hook and loop fasteners, snaps, metal or plastic clips. In some examples, the filler bags 106 can have a double closure mechanism 802. For example, the filler bags can have two overlapping closure mechanisms 802 of the same (e.g., overlapping flaps with hook and loop fasteners) or different type (e.g., a zipper and a flap with hook and loop fasteners). In some examples, the filler bags 106 may have a water tight liner and water tight closure 802 such that the filler bags 106 can be filled with water. In some examples, the filler bags 106 can have a handle attached to an outer surface of the bag.

Figure 9A:
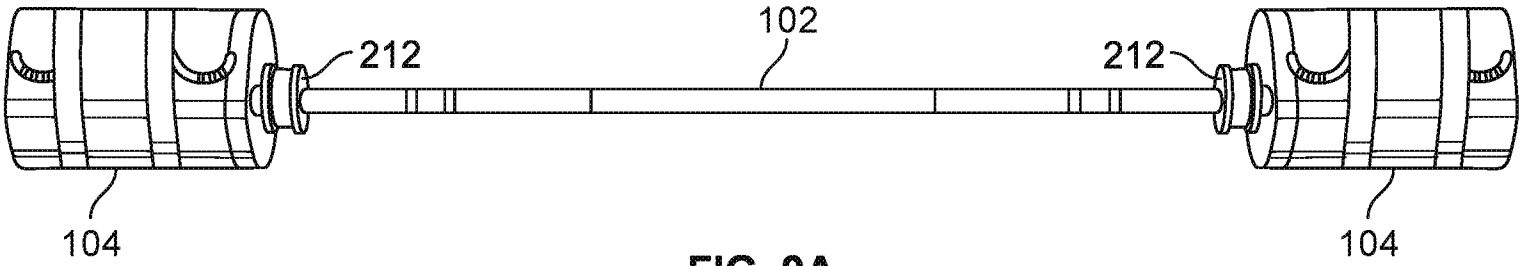
FIGS. 9A-9C depict various methods of attaching weight bags to a barbell in accordance with implementations of the present disclosure.
Figure 9B:
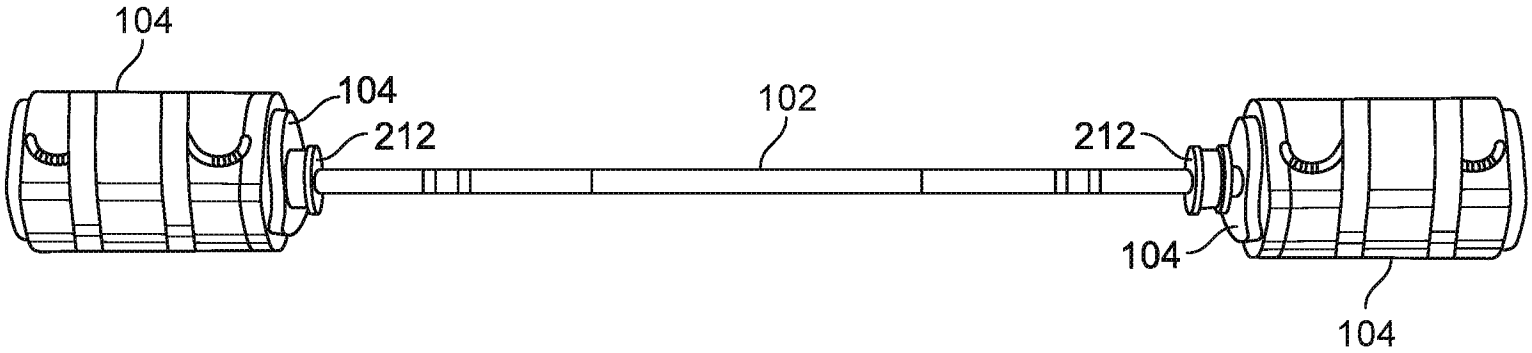
Figure 9C:
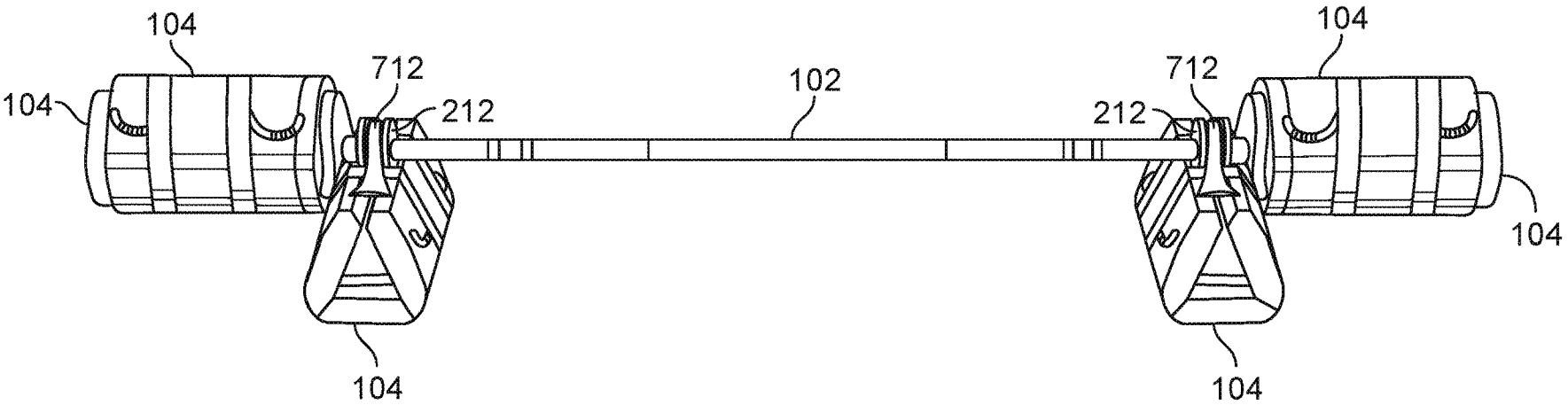

FIGS. 9A-9C depict various methods of attaching weight bags 104 to a barbell 102 in accordance with implementations of the present disclosure. FIG. 9A shows one weight holder 104 attached at each end of the barbell 102. For example, the weight holders 104 are wrapped around the sleeves 214 of the barbell 102. The straps 708 can be pulled snug and attached to the strap fastening devices 710 to securely fasten the weight holders 104 to the barbell 102.

FIG. 9B shows a barbell 102 with four weight holders 104 attached. In some implementations, the straps of the weight holders 104 are long enough that weight holders 104 can be wrapped around each other on a barbell sleeve 214. The first two weight holders 104 are attached as described above in reference to FIG. 9A. Each of the second two weight holders 104 are then wrapped around one of the first two weight holders 104 previously attached to the barbell sleeves 214.

FIG. 9C shows a barbell 102 with six weight holders 104 attached (e.g., a third set of two weight holders 104). In this example, a weight holder 104 is hung on each collar 212 of the barbell. For example, the weight holders 104 can be hung on the collars 212 by placing one of the weight holder handles 712 in the channel 216 of the collar 212. The collar channel 216 prevents weight holders 104 hung in this fashion from sliding during lifts.

Figure 10:
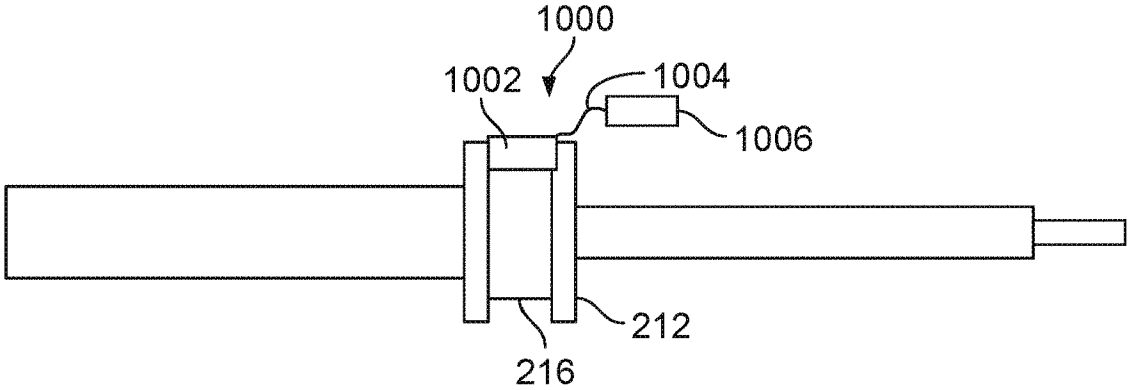
FIGS. 10, 11A and 11B depict an example barbell scale in accordance with implementations of the present disclosure.
Figure 11A:
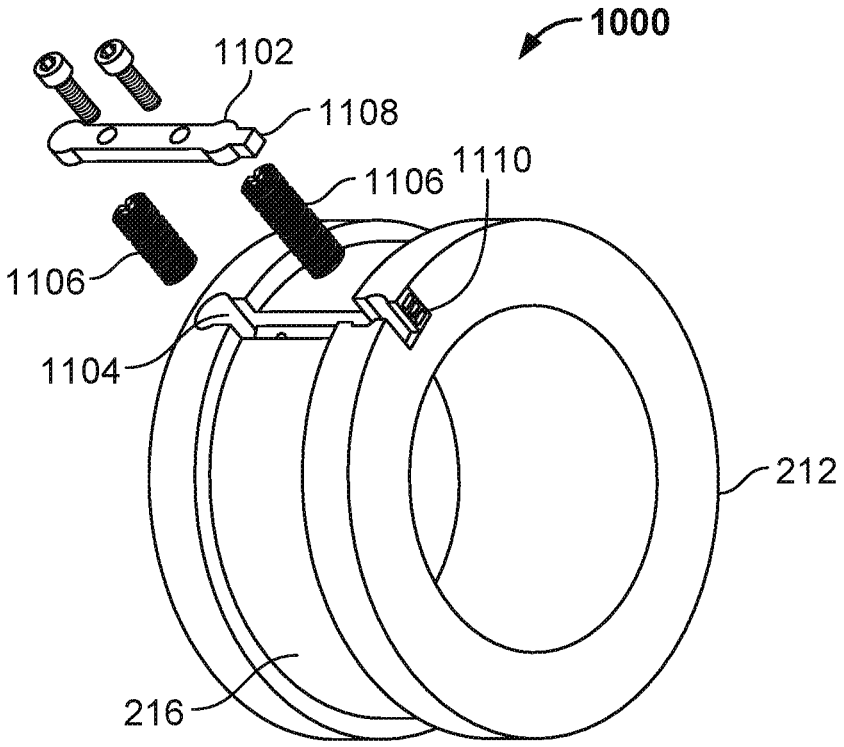
Figure 11B:
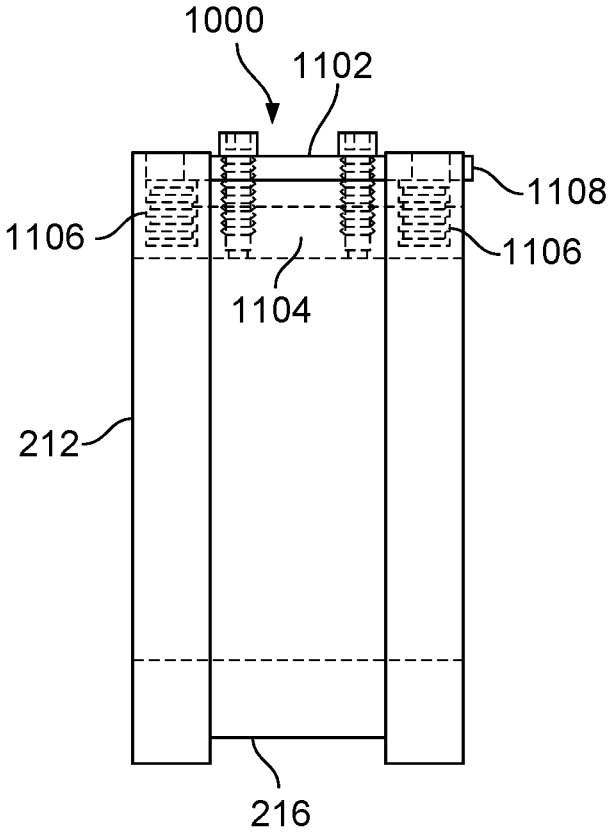

FIG. 10 depicts an example barbell scale 1000. In some implementation, the scale 1000 may be attached to or integrated with a barbell 102. For example, the scale 1000 can be attached to or integrated with the collar 212 on either the male portion 204, the female portion 202, or both. In some implementations, the scale 1000 can be a mechanical scale, as shown in FIGS. 11A and 11B. For example, the scale 1000 can include a moveable element 1102 positioned in a notch 1104 of the collar 212. Springs 1106 are positioned between an inner surface of the notch 1104 and the moveable element 1102. When a weight holder 104 is hung on the collar 212 (e.g., as shown in FIG. 9C), the weight of the weight holder compresses the springs 1106, thereby translating the moveable element 1102 within the notch 1104. A tab 1108 of the moveable element 1102 extends through a side surface of the collar 212 and can serve as a pointer to a calibrated set of weight markings 1110 on the side of the collar 212.

In some implementations, the scale 1000 in pressure sensing device includes an electronic pressure sensor 1002 in electronic communication with an electronic display device 1006, for example, through a detachable wire 1004. The electronic display device 1006 includes one or more processors and a data store storing instructions for processing electrical signals from the electronic pressure sensing device 1002 and displaying a weight. In some examples, the display device can be a mobile computing device such as, for example, a tablet computer or a smartphone. In such implementations, an application executed by the mobile computing device can process the signals from the electronic pressure sensor and display a weight. In some examples, the electronic pressure sensor 1102 can be integrated with a mechanical scale, such as shown in FIGS. 11A and 11B.

While a number of examples have been described for illustration purposes, the foregoing description is not intended to limit the scope of the invention, which is defined by the scope of the appended claims. There are and will be other examples and modifications within the scope of the following claims.

The invention claimed is:

1. A weight training system comprising:

a barbell comprising:

a first end portion, a second end portion, and a middle portion couplable to the first end portion and the second end portion, the middle portion comprising:

a male coupling extending from a first end of the middle portion, the male coupling providing a first coupling mechanism that engages with a corresponding female coupling of the first end portion, and a female coupling providing a second coupling mechanism that engages with a corresponding male coupling of the second end portion; and two or more exercise weights, each exercise weight comprising:

a flexible weight holder having a plurality of chambers, the chambers arranged along a length of the weight holder and oriented transverse to the length of the weight holder, and each chamber having a closure device for securing one or more weights within each chamber, one or more straps attached to a first end of the weight holder, the first end being transverse to the length of the weight holder, and one or more strap fastening devices attached at a second end of the weight holder, the second end being transverse to the length of the weight holder, wherein the weight holder is rolled into a cylinder shape when each of the straps are fastened to corresponding ones of the strap fastening devices.

2. The system of claim 1, further comprising a plurality of filler bags, each filler bag being sized to accommodate an amount of a material that approximates a weight of each filler bag, and each filler bag fitting within the chambers of the weight holders.

3. The system of claim 2, wherein the material is one of water, sand, dirt, or gravel.

4. The system of claim 1, wherein the first end portion is configured to hold a weight at an end of the first end portion opposite the female coupling on the first end portion, and wherein the second end portion is configured to hold a weight at an end of the second end portion opposite the male coupling on the second end portion.

5. The system of claim 1, wherein the barbell further comprises a first cylindrical collar coaxially attached to the first end portion, the first cylindrical collar having a channel formed around an outer circumference of the first cylindrical collar; and a second cylindrical collar coaxially attached to the second end portion, the second cylindrical collar having a channel formed around an outer circumference of the second cylindrical collar.

6. The system of claim 1, wherein the first and second coupling mechanisms are threading.

7. The system of claim 6, wherein the threading extends from the first end of the middle portion along only a portion of a length of the male coupling.

8. The system of claim 6, wherein the threading extends from an end of the second end portion along only a portion of a length of the corresponding male coupling.

9. The system of claim 1, wherein the first and second coupling mechanisms include plunger buttons and corresponding holes.

10. The system of claim 1, wherein the first and second coupling mechanisms include pins.

11. The system of claim 1, wherein the first and second coupling mechanisms include locking sleeves.

12. The system of claim 1, wherein the female coupling of the first end portion and the male coupling of the second end portion are corresponding couplings so as to couple the first end portion with the second end portion without the middle portion.

13. The system of claim 1, wherein the barbell further comprises a weight sensing device mounted on one of the first end portion or the second end portion.

14. The system of claim 13, wherein the weight sensing device is a pressure sensor communicatively coupled to an electronic display.

15. The system of claim 13, wherein the weight sensing device is a mechanical scale.

16. The system of claim 13, wherein the weight sensing device is integrated into a collar attached to the first end portion or the second end portion.

17. The system of claim 1, wherein the strap fastening devices are hook and loop fasteners, and wherein the straps include one of the hooks or the loops of the hook and loop fasteners and the other of the hooks of the loops of the hook and loop fasteners are attached to a surface of the weight holder at the second end.

18. The system of claim 1, wherein the strap fastening devices comprise one of double D-rings, buckles, clips, or snaps.

19. The system of claim 1, wherein each of the two or more exercise weights further comprise at least one handle attached to a surface of the weight holder.

20. The system of claim 1, wherein the weight holder, when rolled into the cylinder shape, defines an passage running transverse to the length of the weight holder, such that the weight holder can be wrapped around an end of a barbell.

* * * * *